US005526970A

United States Patent [19]

Yates

[11] Patent Number: 5,526,970

[45] Date of Patent: Jun. 18, 1996

[54] SUPPORT DEVICE FOR A PORTABLE INSTRUMENT CONTROL BOX

[75] Inventor: Steve K. Yates, Scottland, Pa.

[73] Assignee: Ingersoll-Rand Company, Woodcliff Lake, N.J.

[21] Appl. No.: 520,628

[22] Filed: Aug. 29, 1995

Related U.S. Application Data

[63] Continuation of Ser. No. 417,720, Apr. 6, 1995, abandoned, which is a continuation of Ser. No. 101,125, Aug. 2, 1993, abandoned.

[51] Int. Cl.[6] ..... A45F 5/00

[52] U.S. Cl. ..... 224/270; 224/245; 224/901; 224/610; 224/617; 224/930; 224/901.8; 248/205.2

[58] Field of Search ..... 224/202, 204, 224/206, 208–211, 215, 242, 257–259, 261, 262, 270, 901; 248/205.2

[56] References Cited

U.S. PATENT DOCUMENTS

| | | | |
|---|---|---|---|
| 1,542,163 | 6/1925 | Moroe | 224/209 |
| 3,881,534 | 5/1975 | Gist . | |
| 3,884,403 | 5/1975 | Brewer | 224/204 |
| 4,320,863 | 3/1982 | Lyer et al. | 224/259 |
| 4,690,316 | 9/1987 | Peterson | 224/253 |
| 4,848,624 | 7/1989 | Clem | 224/222 |
| 4,915,278 | 4/1990 | Smith | 224/202 X |
| 4,981,243 | 1/1991 | Rogowski | 224/901 X |
| 5,152,593 | 10/1992 | Domenig | 248/205.2 |
| 5,186,375 | 2/1993 | Plonk | 224/202 |
| 5,205,448 | 4/1993 | Kester et al. | 224/151 |

FOREIGN PATENT DOCUMENTS

| | | | |
|---|---|---|---|
| 0563590 | 10/1993 | European Pat. Off. | 224/202 |
| 0111551 | 8/1944 | Sweden | 224/270 |
| 0120732 | 1/1948 | Sweden | 224/209 |

*Primary Examiner*—J. Casimer Jacyna
*Attorney, Agent, or Firm*—John J. Selko

[57] ABSTRACT

A support device for an operator to carry an instrument control box for a remotely controlled mobile vehicle includes a base member, a pair of side members and a rear member, together forming a support frame having a back end closed by the back member, and adapted to rest against an operator's body, an open front end and an open top end to permit ease of insertion of a control box into the support frame. An adjustable-length strap is connected to the support frame, for supporting the device around an operator's neck. The control box can be detachably connected to the support frame for easy disengagement therefrom.

4 Claims, 3 Drawing Sheets

SUPPORT DEVICE FOR A PORTABLE INSTRUMENT CONTROL BOX

This application is a continuation of application Ser. No. 08/417,720, filed Apr. 6, 1995, now abandoned, which was a continuation of application Ser. No. 08/101,125, filed Aug. 2, 1993, now abandoned.

BACKGROUND OF THE INVENTION

This invention relates generally to remotely controlled vehicles, such as trench compactors, and more particularly to devices for supporting a portable instrument control box on the body of an operator, while freeing the operator's hands to simultaneously operate the instrument switches and joy sticks.

Portable instrument control boxes are equipped with a handle for the operator to carry the box, while he follows a mobile vehicle controlled by the instrument box. These control boxes are often connected to the vehicle being controlled by a retractable power cord. Both hands of the operator are required to operate the switches and joy sticks, and therefore it is difficult for the operator to carry the box and operate the switches and joy stick at the same time. Devices for supporting the control box on the body of an operator must also permit the control box to be readily disengaged from the support device, in the event that the vehicle falls into an open trench or over an embankment. Without easy disengagement, the operator can be dragged along with the vehicle.

The foregoing illustrates limitations known to exist in present remotely controlled mobile vehicles. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a support device for an operator to carry an instrument control box for a remotely controlled mobile vehicle comprising: a support frame having a support base member for carrying said control box, said base member extending between a first and second side edge; a first upwardly extending side member connected to said first side edge; a second upwardly extending side member connected to said second side edge; and an upwardly extending back member connected to said base member, said back member extending between said first and second side members; and a strap means having a first end connected to said first side member, a second end connected to said second side member and having a sufficient length for extending upwardly around an operator's neck whereby said operator can carry said control box while having hands free for simultaneously operating said control box.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
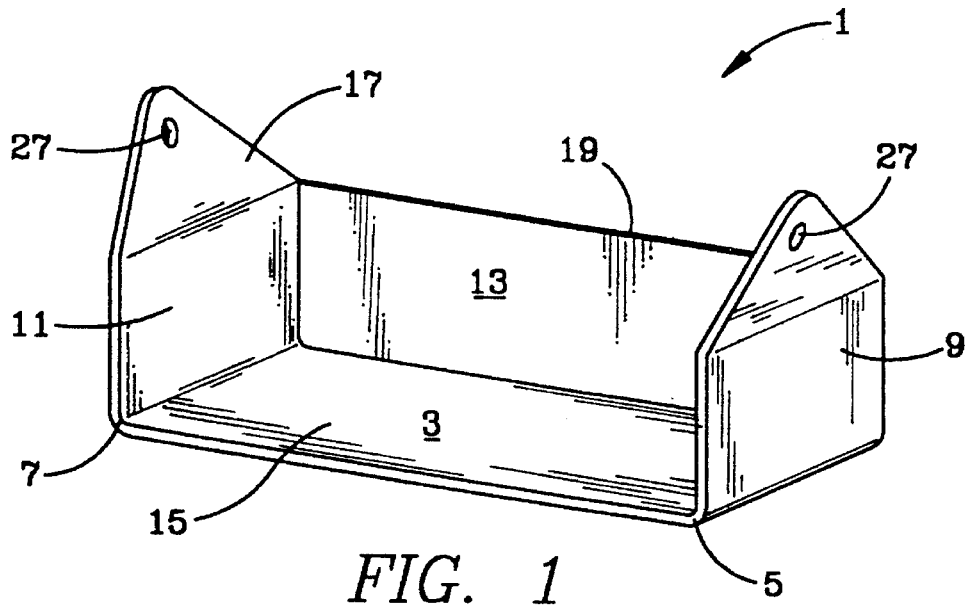
FIG. 1 is a perspective view, with parts removed, of the support frame of this invention.
Figure 2:
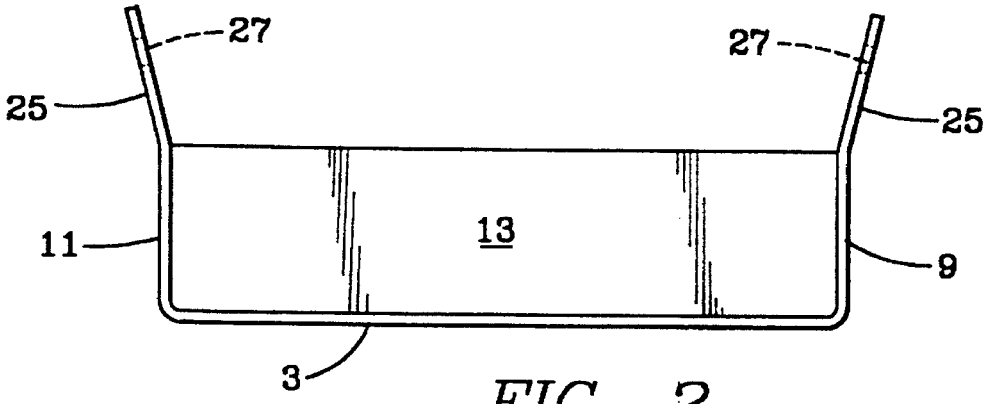
FIG. 2 is a front elevational view of the support frame, with parts removed.
Figure 3:
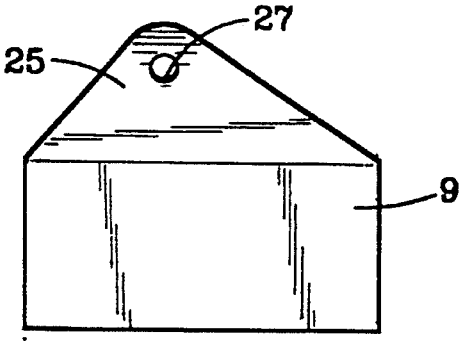
FIG. 3 is a elevational side view of FIG. 2.
Figure 4:
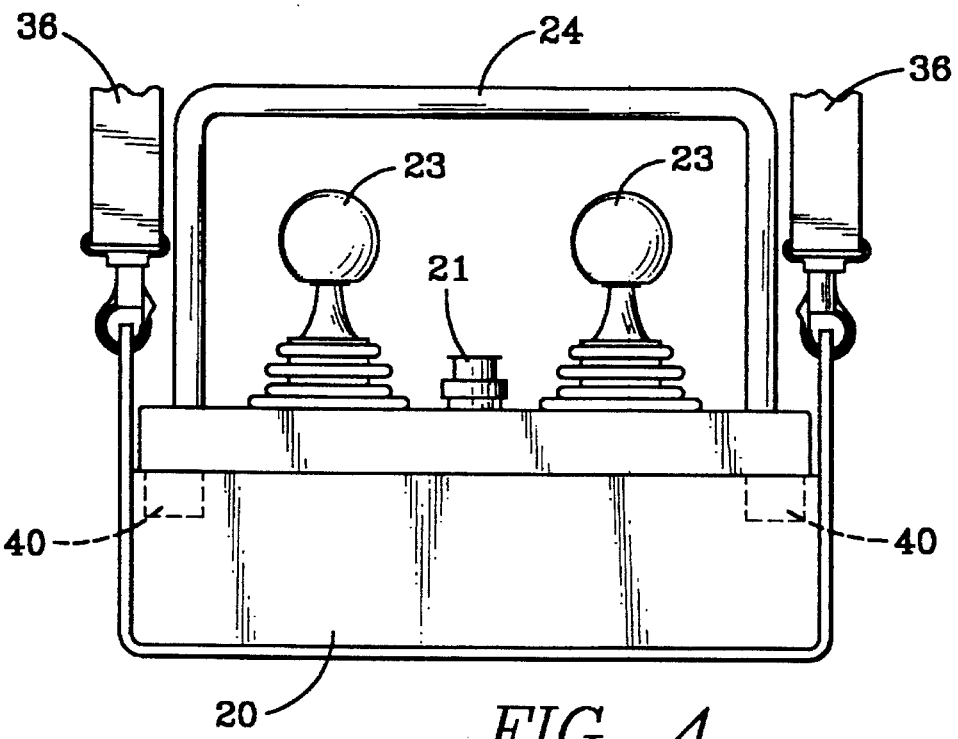
FIG. 4 is a front elevational view of the support frame, with an instrument control box therein.

Now referring to FIG. 1, there is shown the support device of this invention, with parts removed, comprising a support frame 1, said support frame having a base member 3, extending between a first side edge 5 and a second side edge 7. A first, upwardly extending side member 9 is connected to said first side edge 5, and a second, upwardly extending side member 11 is connected to second side edge 7. Upwardly extending back member 13 is connected to base member 3, and extends between first and second side edges, 5 and 7. Thus, it can be understood that base member 3, side members 9 and 11 and back member 13 combine to form a support platform that forms and opening at front end 15 and top end 17, while being closed at back end 19. Back end 19 is adapted to rest against the body of an operator. Openings 15, 17 permit ease of insertion of control box 20 (FIG. 4) into frame 1 and also ready access of an operator's hands to the switches 21 and joy sticks 23 of the control box 20. Control box 20 is of a conventional type used for remotely controlling a mobile vehicle (not shown), such as a trench compactor. Control box 20 has its front exposed via opening 15 for connection of a retractable power cord 21 (FIG. 5) that ultimately connects to a device being controlled by the operator. Handle 24 on control box 20 is for the operator to carry control box 20, when it is not on support frame 1. For ease of insertion of control box 20 into frame 1, I prefer first and second side members 9 and 11 flare outwardly away from each other adjacent a top edge 25 of said side members and 11, as shown in FIG. 2. Side members 9 and 11 can also be non-flared.

Figure 6:
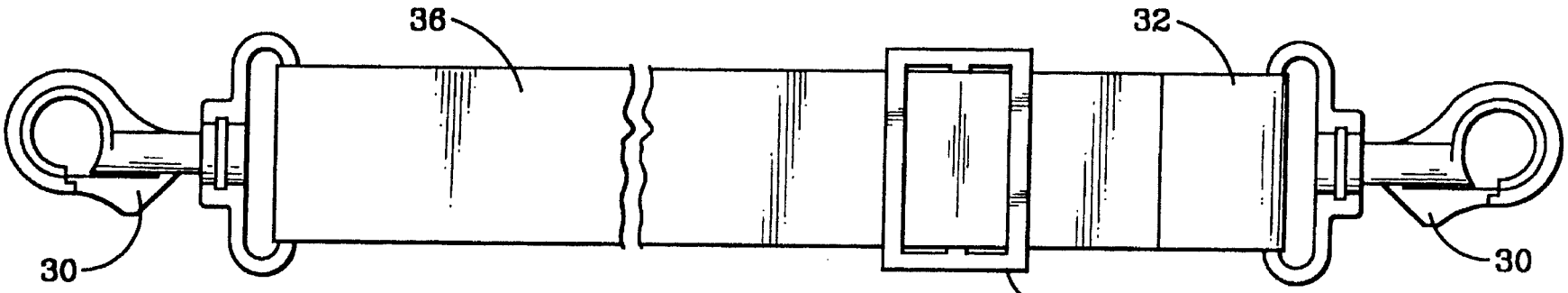
FIG. 6 is a schematic plan view of an adjustable strap.

Side member 9 and 11 each has an aperture 27 therethrough for attachment of a pair of conventional detachable swivel hook devices 30 (FIG. 6). One hook 30 is connected to a first end 32 and to a second end 34 of an adjustable-length strap 36. I prefer a strap length between 34 and 67 inches. FIG. 6 shows an adjustable length strap 36 of conventional design. Strap 36 is looped over buckle 37, which can be moved back and forth to adjust length of strap 36, as is well known. Strap 36 is long enough to extend upwardly around the neck of an operator (not shown), whereby the operator can carry the support frame 1, with the control box 20 therein, while having hands free for simultaneously operating the a switches 21 and joy sticks 23 of the control box 20.

Figure 5:
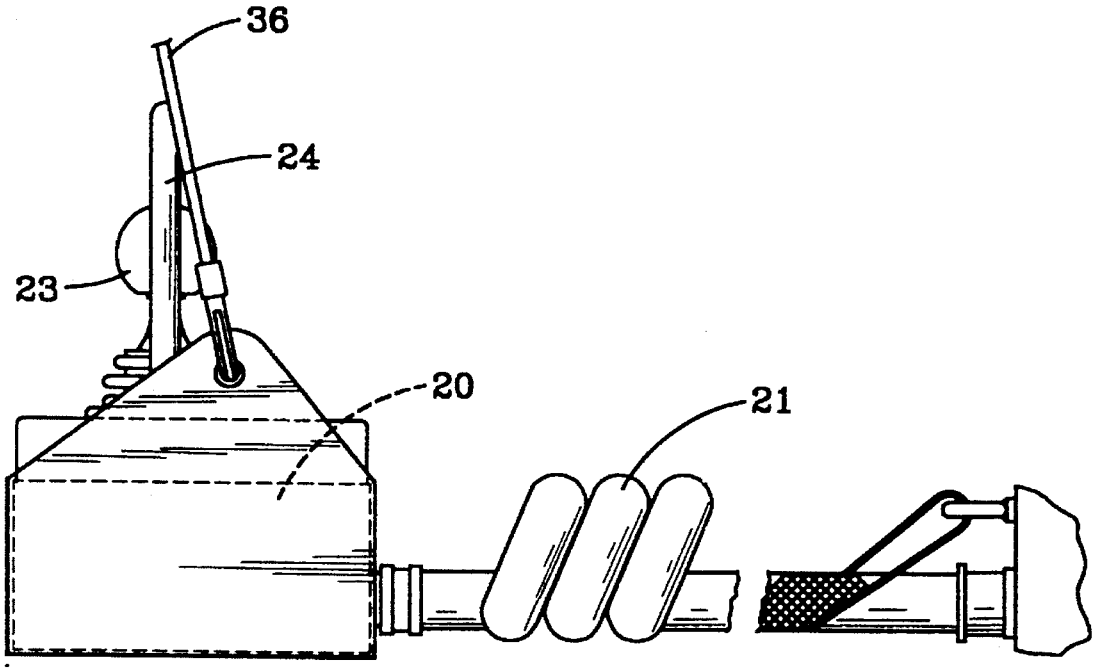
FIG. 5 is a side elevational view of FIG. 4, showing a retractable power cord attached to the instrument box.
Figure 8:
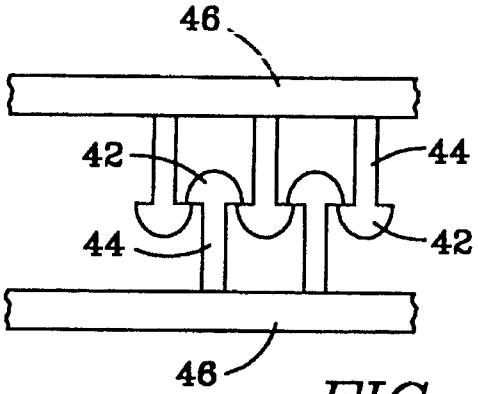
FIG. 8 is a view similar to FIG. 7, with elements interlocked.
Figure 7:
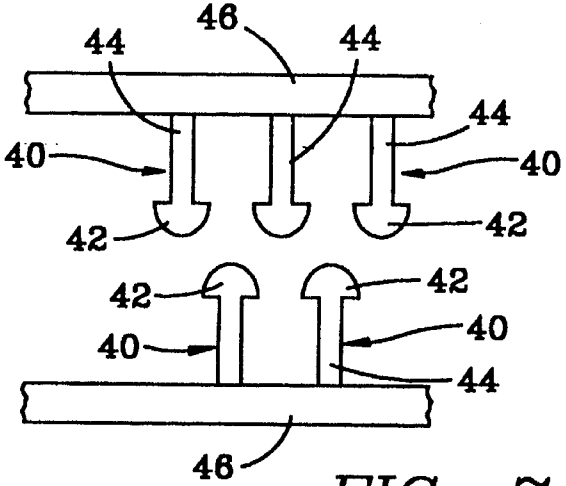
FIG. 7 is a schematic view of a stem and mushroom head interlock system, with elements not interlocked.

Control box 20 can also be detachably connected to support frame 1 by connection devices sold by The Minnesota Mining and Manufacturing Company under the trademark DUAL LOK. This system is known as a stem and mushroom head interlock system. As shown in FIGS. 7 and 8, this system comprises a plurality of plastic members 40 in the form of mushroom heads 42 and stems 44. Members 40 are carried on a front surface of a base pad 46, which has a suitable adhesive on a back surface thereof. When members 40 are forced together, the mushroom heads 42 interlock, as shown in FIG. 8. When members 40 are pulled apart, the mushroom heads 42 unlock, as shown in FIG. 7. At least one pad 46 is fastened to support frame 1, either at back member 9 or side members 5, 7 or both. A complementary pad 46 is fastened to a matching position on the control box 20, whereby when control box 20 is placed into support frame it is detachably locked in place by the DUAL LOK. This attachment means is preferred when the control box 20 is connected to a vehicle by a retractable power cord 21, as shown in FIG. 5. It provides some degree of secure holding of the control box 20 under normal conditions, but it also permits the control box 20 to be readily disengaged from support frame 1, without dragging the operator along, in the event that the vehicle falls into an open trench or over an embankment.

An alternative, but less desirable attachment means would be hook and loop fasteners such as VELCRO brand fasteners, patented 1955, U.S. Pat. No. 2,717,437,, company, Velcro Company, Switzerland.

Having described the invention, what is claimed is:

1. A support device and instrument control box for a remotely controlled mobile vehicle comprising:

a. a support frame having:

(i) a support base member for carrying said control box, said base member extending between a first and second side edge;

(ii) a first upwardly extending side member connected to said first side edge;

(iii) a second upwardly extending side member connected to said second side edge;

(iv) an upwardly extending back member connected to said base member, said back member extending between said first and second side members, and extending upwardly above said support base member; and (v) said first and second side members flaring outwardly away from each other adjacent an upper end;

b. a strap means having a first end connected to said first side member, a second end connected to said second side member and having a sufficient length for extending upwardly around an operator's neck whereby said operator can carry said control box while having hands free for simultaneously operating said control box;

c. said base member, said first and second side members, and said back member forming a support frame having a back end closed by said back member, and adapted to rest against an operator's body, an open front end and an open top end;

d. a control box on said base member, said control box having a front end facing outwardly toward said open front end for connection of a retractable power cord;

e. handle means on said control box, for an operator to carry said control box; and f. attachment means for removably connecting to, and detaching from, said control box to retain said control box detachably in said support frame.

2. The support device of claim 1 wherein said strap means is adjustable in length.

3. The support device of claim 2 wherein said strap means is removably connected to said support frame.

4. The support device of claim 3 wherein said attachment means comprises a combination of stem and mushroom head interlock elements, and said support frame includes at least one of said stem and mushroom head elements, when the remote control box includes a complementary stem and mushroom head element.

* * * * *